US008926035B2

(12) United States Patent
Armstrong

(10) Patent No.: US 8,926,035 B2
(45) Date of Patent: Jan. 6, 2015

(54) SHELF SUPPORT ASSEMBLY FOR A RIBBED APPLIANCE CAVITY

(71) Applicant: General Electric Company, Schenectady, NY (US)

(72) Inventor: James Lee Armstrong, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/775,378

(22) Filed: Feb. 25, 2013

(65) Prior Publication Data

US 2014/0239793 A1 Aug. 28, 2014

(51) Int. Cl.

| | |
|---|---|
| ***A47B 81/00*** | (2006.01) |
| ***F24C 15/16*** | (2006.01) |
| ***A47B 96/02*** | (2006.01) |

(52) U.S. Cl.

CPC ..... *F24C 15/16* (2013.01); *A47B 96/025* (2013.01)

USPC ..... 312/410; 312/334.8

(58) Field of Classification Search

CPC ..... A47B 88/0451; A47B 2210/0059; F24C 15/16; F24C 15/162; F24C 15/168

USPC ..... 312/408, 410, 334.4, 334.7, 334.8, 312/334.9, 334.11–334.12; 126/339–340, 126/337 A, 337 R

See application file for complete search history.

(56) References Cited

U.S. PATENT DOCUMENTS

| | | | | | |
|---|---|---|---|---|---|
| 317,845 | A * | 5/1885 | Osgood | 211/153 |
| 434,970 | A * | 8/1890 | Allyn | 126/339 |
| 525,723 | A * | 9/1894 | Schambrue | 211/153 |
| 577,758 | A * | 2/1897 | Keyser | 211/153 |
| 1,259,210 | A * | 3/1918 | Clark | 52/799.1 |
| 1,891,394 | A * | 12/1932 | Otte | 126/337 R |
| 2,076,099 | A * | 4/1937 | Smith et al. | 211/153 |
| 2,217,987 | A * | 10/1940 | Langel | 220/23.6 |
| 2,550,980 | A * | 5/1951 | Drake | 312/408 |
| 4,759,341 | A * | 7/1988 | McFarland | 126/339 |
| 6,330,777 | B1 * | 12/2001 | Padley | 52/670 |
| 6,938,617 | B2 * | 9/2005 | Le et al. | 126/339 |
| 7,290,320 | B2 | 11/2007 | Blankenship | |
| 7,735,481 | B1 * | 6/2010 | Kalsi et al. | 126/337 R |
| 8,469,470 | B2 * | 6/2013 | Hecht et al. | 312/408 |
| 8,628,158 | B2 * | 1/2014 | Caveney | 312/265.3 |
| 8,695,197 | B2 * | 4/2014 | Schrubke et al. | 29/434 |
| 2008/0237166 | A1 | 10/2008 | Williams et al. | |
| 2008/0265734 | A1 * | 10/2008 | Hecht et al. | 312/408 |
| 2009/0056365 | A1 * | 3/2009 | Benz et al. | 62/441 |
| 2010/0026156 | A1 * | 2/2010 | Leconte et al. | 312/408 |
| 2010/0218755 | A1 * | 9/2010 | Stewart et al. | 126/339 |
| 2012/0090594 | A1 * | 4/2012 | Rehage et al. | 126/339 |
| 2012/0138041 | A1 * | 6/2012 | Jahrling | 126/19 R |
| 2012/0145141 | A1 | 6/2012 | Metcalf et al. | |

* cited by examiner

*Primary Examiner* — Hanh V Tran

(74) *Attorney, Agent, or Firm* — Dority & Manning, P.A.

(57) ABSTRACT

A shelf support assembly is provided that may be used with an oven appliance having protrusions along the walls of the cabinet for suspending the shelf support assembly therebetween. The shelf support assembly can include on each side a metal sheet configured to support a shelf that can be selectively extended from within the oven cavity. The shelf support assembly can be provided with one or more coatings for protection and self-cleaning. An appliance incorporating such a shelf support assembly is also provided.

19 Claims, 7 Drawing Sheets

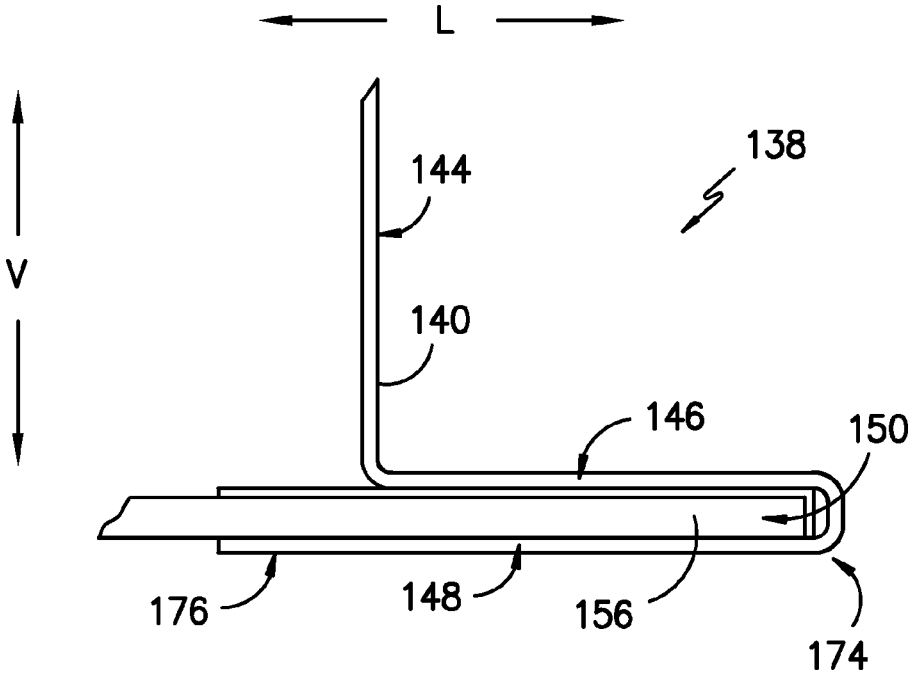
FIG. –7–
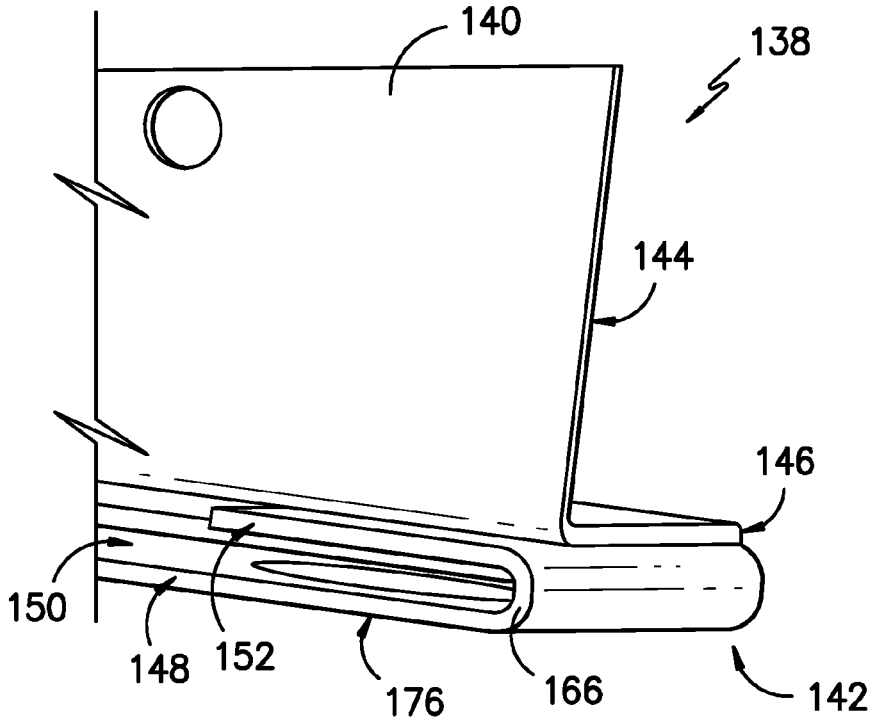
FIG. –8–

SHELF SUPPORT ASSEMBLY FOR A RIBBED APPLIANCE CAVITY

FIELD OF THE INVENTION

The subject matter of the present disclosure relates generally to an extendable shelf for an appliance having a ribbed cavity.

BACKGROUND OF THE INVENTION

Conventional oven appliances are commonly equipped with one or more shelves (frequently referred to as "racks") that are located in the cooking chamber of the appliance. The interior walls of the oven cavity are provided with protrusions or projections upon which the racks are received. The racks can slide back and forth on these protrusions. Additionally, protrusions at multiple levels may be provided so that a user of the appliance can adjust the height to accommodate utensils of various sizes and/or determine the distance between the utensil and one or more heating elements used for cooking food.

A common construction for oven racks utilizes elongated rods that are e.g., welded together. The rods are configured in a grid-like manner that allows for the support of food or a cooking utensil. Open spaces between the rods also allow for a free flow of air that promotes more uniform heating and proper cooking. The rack may also be designed with additional features—also constructed from elongated rods—to support the rack on the protrusions and to limit the extent to which the rack can slide out of the oven.

The manufacturing process for such racks can be complex and time consuming. The rods must be provided at appropriate lengths and shapes and then welded together in the configuration desired. The addition of features such as handles and structure to support the rack on the protrusions adds to this complexity.

Another challenge in the design and construction of oven racks relates to the cleaning and appearance of the racks. During use, the racks are exposed to very high temperatures during both the cooking and cleaning process. Depending on the material of construction, high temperatures can discolor the racks in a manner that is displeasing to the user. Additionally, food may be deposited on the racks during use. Again, depending on the material of construction, such deposits can be difficult to remove during cleaning and/or may leave an undesirable discoloration even after cleaning.

Accordingly, an oven shelf or rack that can be more readily constructed would be useful. Such an oven shelf that can be manufactured with features that reduce or eliminate the use of elongated rod type constructions would also be useful. A shelf that can also be provided with one or more coatings for protection of the shelf rack would be beneficial. An oven appliance containing one or more such shelves would also be beneficial.

BRIEF DESCRIPTION OF THE INVENTION

The present invention provides a shelf support assembly that may be used with an oven appliance having protrusions along the walls of the cabinet for suspending the shelf support assembly therebetween. The shelf support assembly can include on each side a metal sheet configured to support a shelf that can be selectively extended from within the oven cavity. The shelf support assembly can be provided with one or more coatings for protection and self-cleaning. An appliance incorporating such a shelf support assembly is also provided. Additional aspects and advantages of the invention will be set forth in part in the following description, or may be apparent from the description, or may be learned through practice of the invention.

In one exemplary embodiment, the present invention provides an extendable shelf support assembly for an appliance. The shelf support assembly defines vertical, lateral, and transverse directions. The shelf support assembly includes a shelf extending between a pair of opposing sides. A pair of shelf supports are positioned along the opposing sides of the shelf. The shelf is configured to slide between the pair of shelf supports. Each shelf support includes a metal sheet extending longitudinally along the transverse direction between a pair of distal ends. The metal sheet defines a lateral cross-section in a vertical plane that defines a first portion extending along the vertical direction, and a second portion and a third portion that are both parallel to the lateral direction and connected along one side to create a channel that extends longitudinally along the transverse direction. The metal sheet also defines a pair of fingers, one at each distal end, with each finger folded into the channel and welded to the second portion, third portion, or both.

In another exemplary embodiment, the present invention provides a shelf support assembly for an appliance. The shelf support assembly defines vertical, lateral, and transverse directions. The shelf support assembly includes a shelf extending between a pair of opposing sides. A pair of shelf supports are provided upon which the shelf is suspended. Each shelf support extends along the longitudinal direction between a pair of distal ends and includes a first portion lying in a plane orthogonal to the lateral direction, a second portion lying in a plane orthogonal to the vertical direction; and a third portion lying in a plane orthogonal to the vertical direction. The third portion and second portion are joined along one side of the shelf support to create a U-shaped slot. A pair of fingers are provided with each finger connected with one of the distal ends of shelf support. Each finger extends into the U-shaped channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 7 provides a close up, cross-sectional view of an exemplary metal sheet used with the shelf support assembly of FIG. 6. The cross-sectional view of a lateral cross-section is taken in a vertical plane along lines 7-7 as shown in FIG. 6.

FIG. 8 is another view of the distal end shown in FIG. 7 but illustrated from a different angle than FIG. 7.

DETAILED DESCRIPTION OF THE INVENTION

Figure 1:
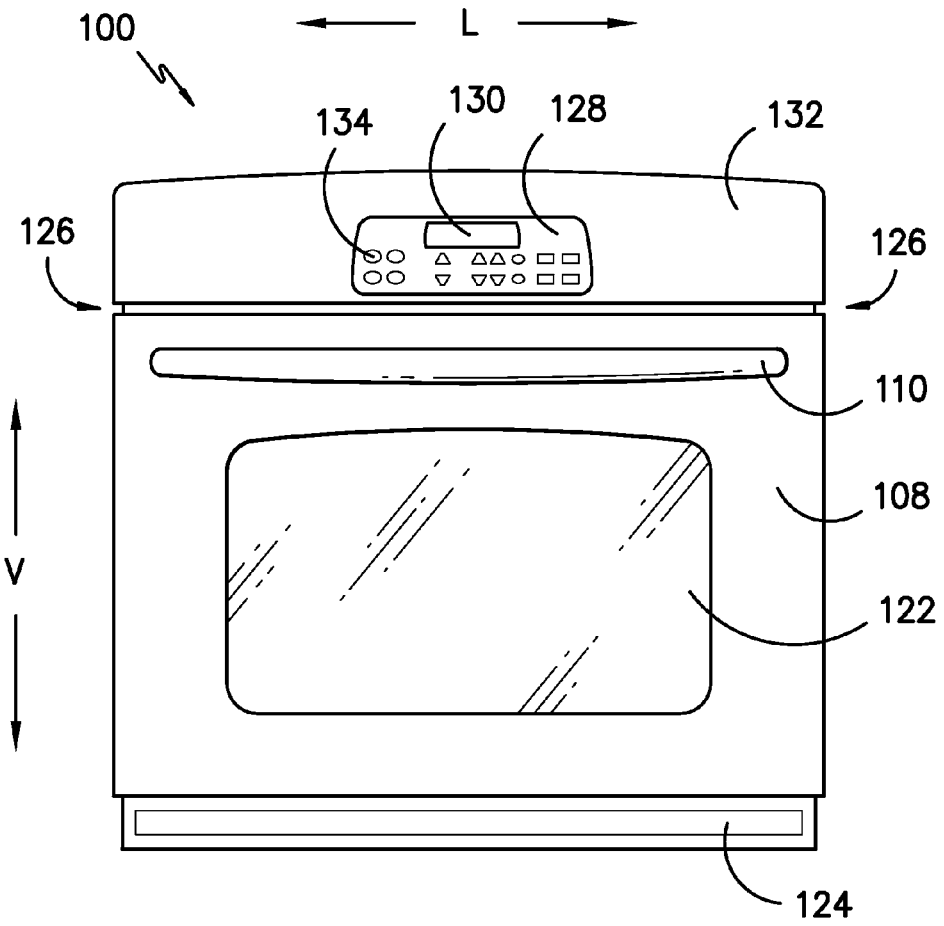
FIG. 1 is a front view of an exemplary embodiment of an oven appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
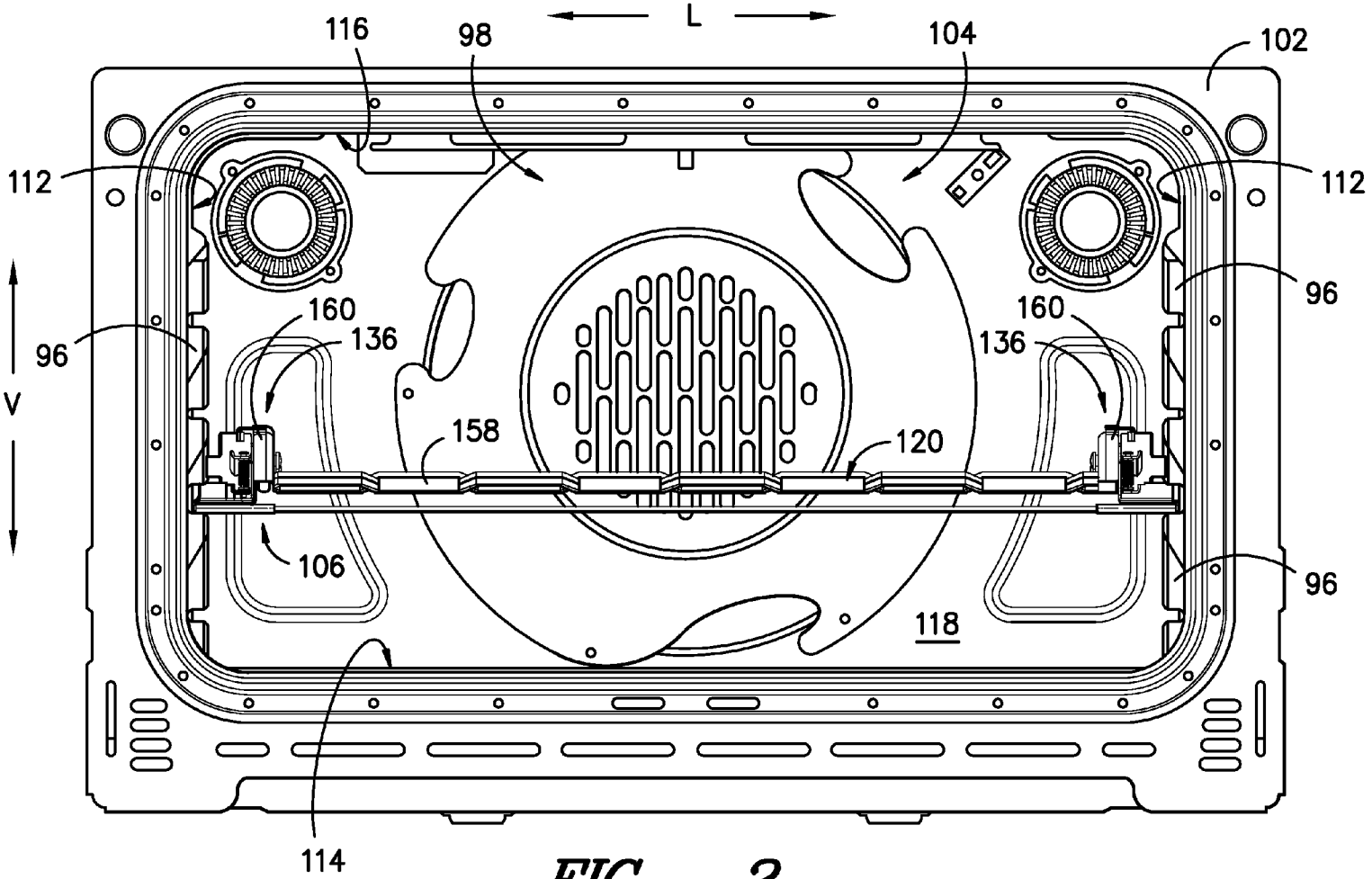
FIG. 2 is a front view of an exemplary appliance cabinet, as may be used in the oven of FIG. 1, shown with an oven cavity incorporating an exemplary embodiment of a vertically adjustable shelf support assembly of the present invention.
Figure 3:
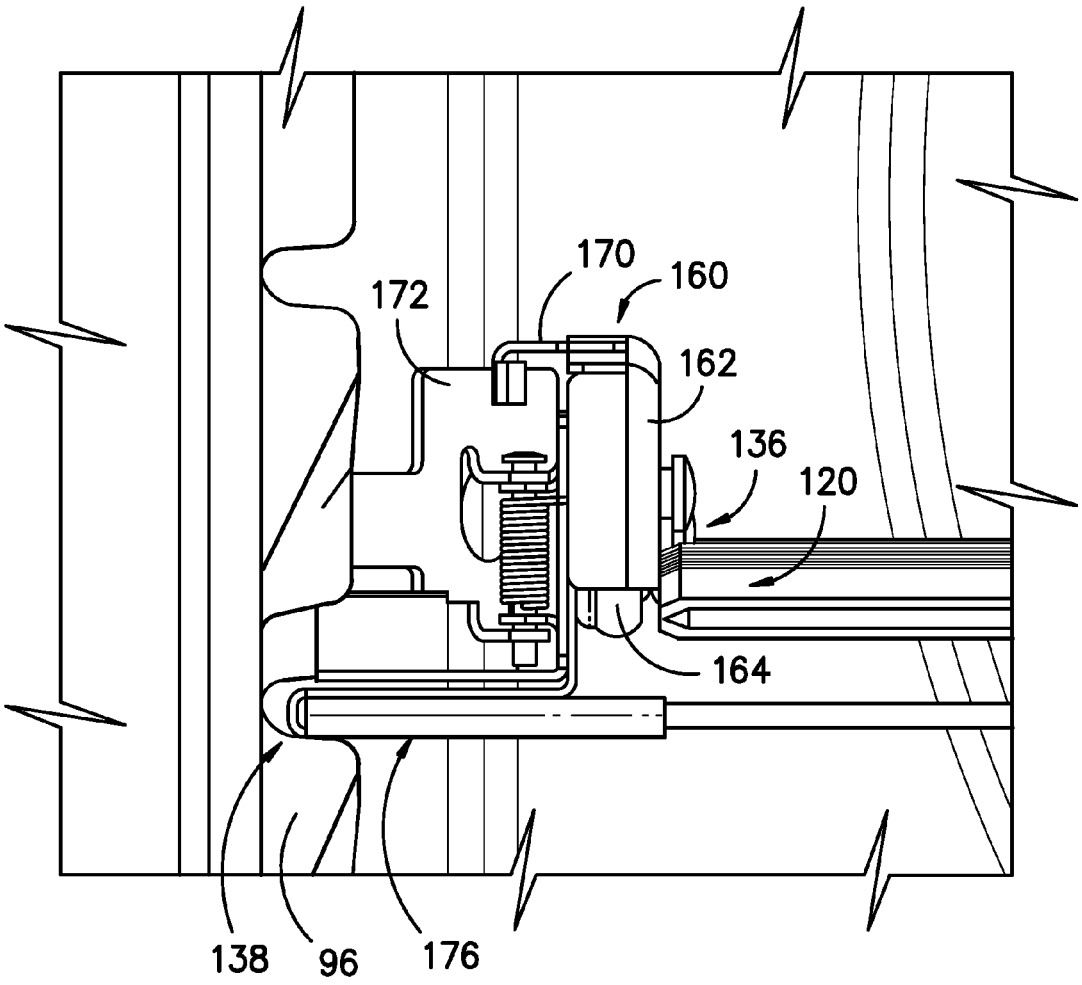
FIG. 3 is a close up, front view along one side of the exemplary shelf support assembly of FIG. 2.
Figure 4:
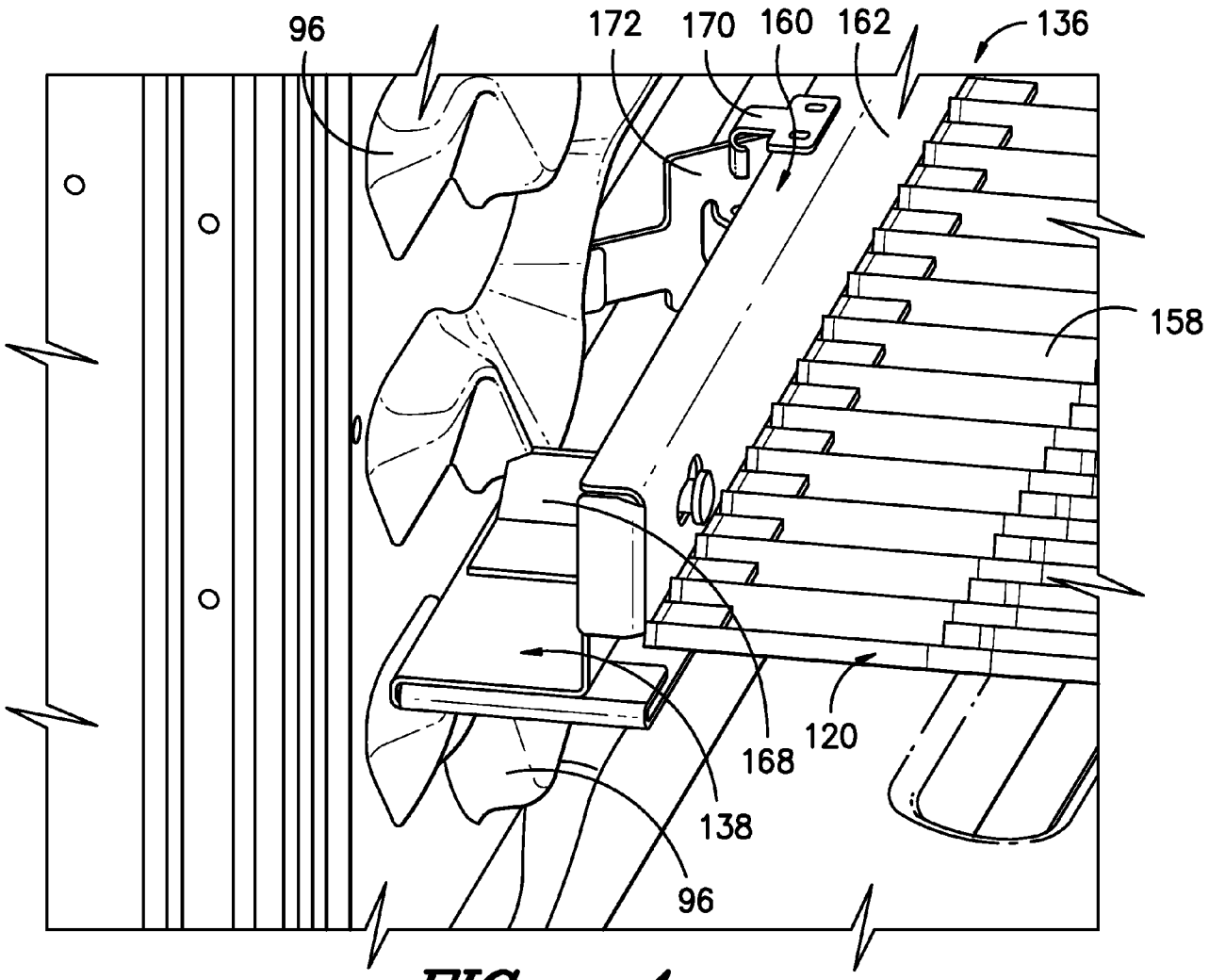
FIG. 4 is a close up, perspective view along one side of the exemplary shelf support assembly of FIG. 2.
Figure 5:
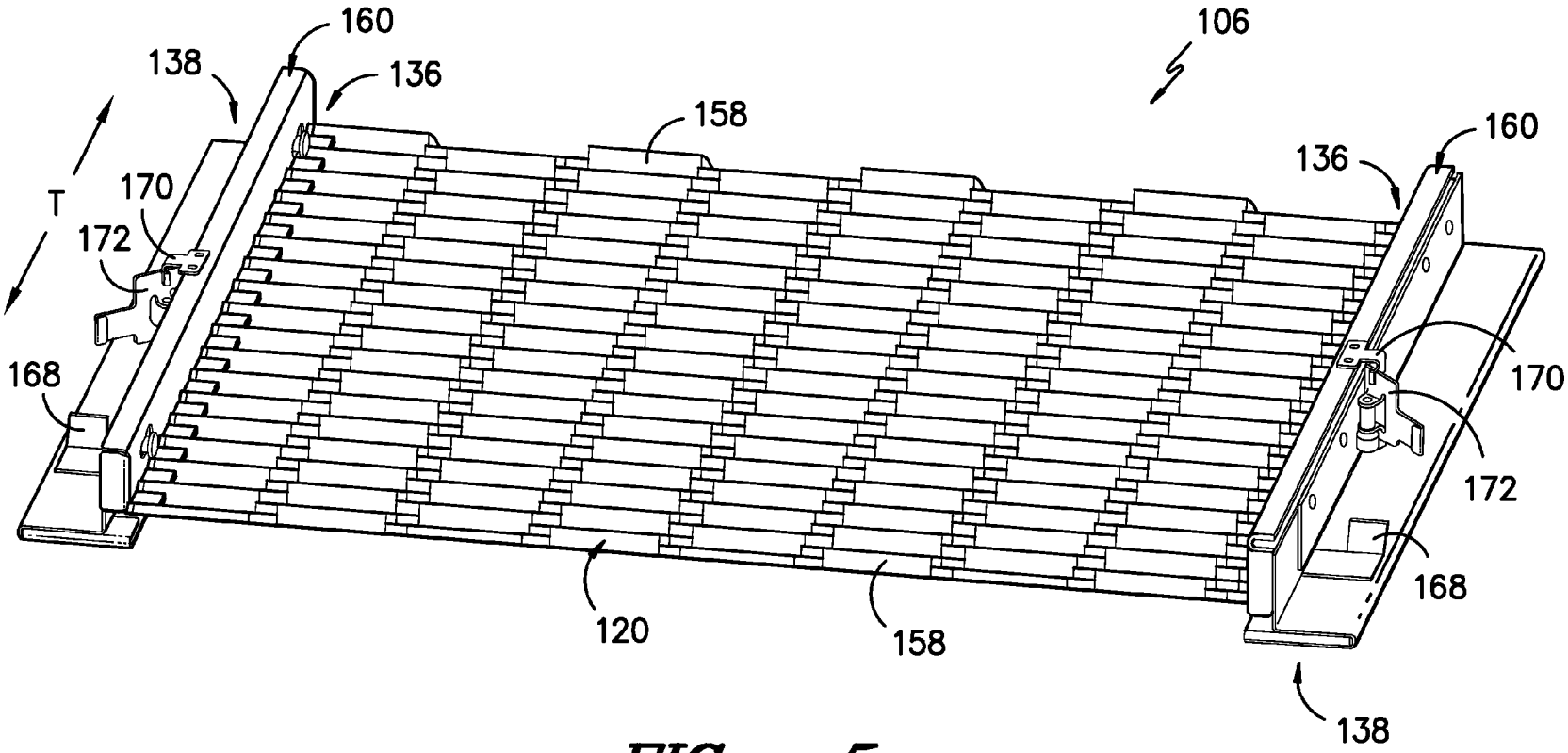
FIG. 5 is a perspective view of the exemplary shelf support assembly of FIG. 2.

Referring to FIG. 1, an exemplary embodiment of an oven 100 according to the present invention is shown. FIG. 1 provides a front view of oven 100 while FIG. 2 provides a front perspective view into the cabinet 102 of oven 100, which defines an exemplary cooking chamber or cavity 104 into which a vertically adjustable shelf support assembly 106 has been installed. As used herein, "shelf" includes a "rack" as constructed from elongated wire structure and also includes a shelf constructed from other materials such as expanded metal and others. Accordingly, "rack" and "shelf" (and the plural forms thereof) are used interchangeably herein.

Oven 100 includes a door 108 with handle 110 that provides for opening and closing access to oven cavity 104 through opening 98 at the front of cavity 104. A user of the appliance 100 can place a variety of different items to be cooked in oven cavity 104, which is defined by a pair of opposing side walls 112, bottom wall 114, top wall 116, and rear wall 118 that extends laterally between opposing side walls 112. Multiple oven shelves or racks 120 can be positioned within cavity 104 (only one shelf 120 is shown) on shelf support assembly 106. The support and height adjustability of shelf 120 using shelf support assembly 106 will be further described.

One or more heating elements (not shown) can be positioned e.g., at the top of chamber 104 to provide heat for cooking and cleaning. Such heating element(s) can be e.g., gas, electric, microwave, or a combination thereof. Other heating elements can be located at the bottom of chamber 104 as well. A window 122 on door 108 allows the user to view e.g., food items during the cooking process. For purposes of cooling, inlet 124 allows for an inflow of ambient air into a ventilation system while vent 126 allows for the outflow of such air after it has been heated by oven 100.

Oven 100 includes a user interface 128 having a display 130 positioned on top panel 132 with a variety of controls 134. Interface 128 allows the user to select various options for the operation of oven 100 including e.g., temperature, time, and/or various cooking and cleaning cycles. Operation of oven appliance 100 can be regulated by a controller (not shown) that is operatively coupled i.e., in communication with, user interface panel 128, heating element(s), and other components of oven 100 as will be further described.

For example, in response to user manipulation of the user interface panel 128, the controller can operate one or more heating element(s). The controller can receive measurements from a temperature sensor (not shown) placed in oven cavity 104 to e.g., provide a temperature indication to the user with display 130. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 128 or otherwise within top panel 132. In such an embodiment, input/output ("I/O") signals are routed between the controller and various operational components of appliance 100 such as heating element(s), controls 134, display 130, sensor(s), alarms, and/or other components as may be provided. In one embodiment, the user interface panel 128 may represent a general purpose I/O ("GPIO") device or functional block.

Although shown with touch type controls 134, it should be understood that controls 134 and the configuration of appliance 100 shown in FIG. 1 is provided by way of example only. More specifically, user interface 128 may include various input components, such as one or more of a variety of electrical, mechanical or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses. Also, oven 100 is shown as a wall oven but the present invention could also be used with other appliances such as e.g., a stand-alone oven, an oven with a stove-top, and non-oven appliances as well.

Shelf support assembly 106 includes a shelf 120 extending between a pair of opposing sides 136. Referring now to FIGS. 2, 3, 4, and 5, assembly 106 includes a pair of shelf supports 138 positioned along the opposing sides 136 of shelf 120. Shelf 120 is slidable along transverse direction T between shelf supports 138. More specifically, in this exemplary embodiment, shelf support assembly 106 also includes a pair of slide assemblies 160. Each slide assembly 160 include a carrier 162 attached to one of the opposing sides 136 of shelf 120 and a base 164 onto which carrier 162 is slidably received such that carrier 162 can be slid along base 164. Accordingly, shelf 120 can be extended along the transverse direction T in and out of oven cavity 104. Ball bearings (not shown) may be used with slide assembly 160 to facilitate movement of carrier 162 relative to base 164. Slide assemblies 160 are provided by way of example, other constructions may be used as well for facilitating the transverse movement of shelf 120.

Referring specifically now to FIGS. 5, 6, 7, and 8, each shelf support 138 also includes a metal sheet 140 that extends longitudinally along transverse direction T between a pair of distal ends 142. As best seen in FIG. 7, each metal sheet 140 defines a lateral cross-section in a vertical plane that includes a first portion 144, second portion 146, and third portion 148. First portion 144 extends along vertical direction V. Second portion 146 and third portion 148 are both parallel to lateral direction L and are connected along one side 174 to create a channel 150 or U-shaped slot 150 that extends longitudinally along transverse direction T—i.e. along the length of metal sheet 140.

Continuing with FIG. 7, first portion 144 of each shelf support 138 lies in a vertical plane that is orthogonal to the lateral direction L. Second portion 146 of each shelf support 138 lies in a plane that is orthogonal to the vertical direction V. Third portion 148 of each shelf support 138 lies in a plane that is also orthogonal to vertical direction V and parallel to the plane that includes second portion 146. Second portion 146 and third portion 148 are joined along each side 174 to create U-shaped slot 150.

Referring now to FIGS. 7 and 8, each metal sheet 140 defines a pair of fingers 152. Each finger 152 is folded into channel 150 of a respective metal sheet 140 to create fold 166 at each distal end 142 of sheets 140. In one exemplary embodiment, each finger 152 is welded to the second portion 146, third portion 148, or both, to provide additional strength. Each metal sheet 140 can be e.g., punched or cut from a larger metal sheet and folded to create the portions and fingers as described herein. Metal sheet 140 can be constructed from a variety of different metals including stainless steel and others.

Figure 6:
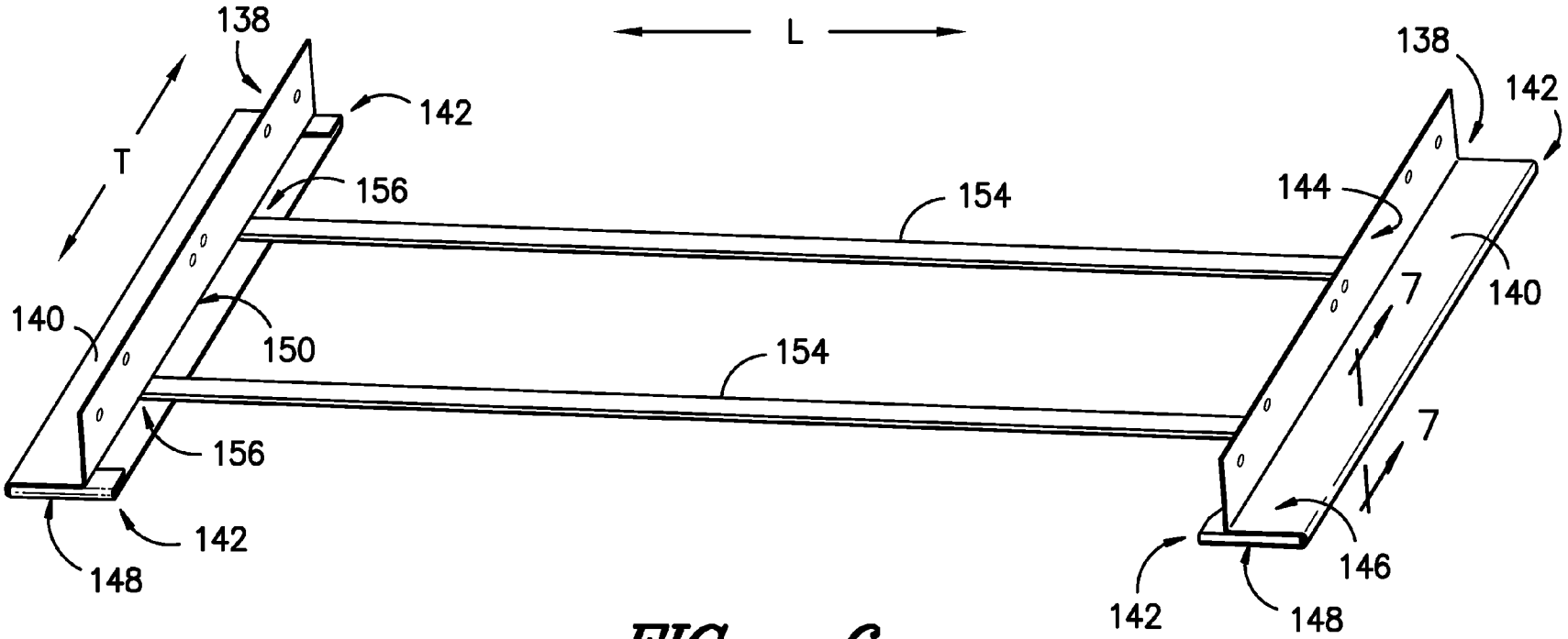
FIG. 6 is a perspective view of the exemplary shelf support assembly as shown in FIG. 5 and with a shelf removed to more clearly reveal certain components of the assembly.

As shown in FIG. 6, shelf support assembly 106 is also equipped with a pair of braces 154. Each brace 154 extends along lateral direction L between a pair of ends 156. Each end 156 of brace 154 is inserted into one of the channels 150 formed by the pair of shelf supports 138. For this exemplary embodiment, each end 156 is welded to one of the shelf supports 138.

Shelf 120 is constructed from expanded metal 158 for the exemplary embodiment shown in the figures. Using the teachings disclosed herein, however, it will be understood that shelf 120 could be constructed from elongated metal rods and other constructions as well. In either case, shelf support assembly 106 including shelf 120 can be coated with one or more materials that protect assembly 106 during the relatively extreme temperatures that can be experienced during cooking operations. For example, ceramic, Teflon®, and other materials may be used to provide coatings as well.

Returning to FIG. 2, shelf support assembly 106 allows shelf 120 to be extendable along transverse direction T in and out of cavity 104. In turn, shelf support assembly 106 is supported by a pair of protrusions 96 positioned at the same height along vertical direction V in cavity 104. A plurality of protrusions 96 are provided along opposing side walls 112 of cooking chamber 104. For this exemplary embodiment, each protrusion 96 extends longitudinally along transverse direction T and projects into cavity 104 from one of the opposing side walls 112.

The vertical position of shelf support assembly 106 can be readily adjusted by repositioning assembly 106 upon a different pair of protrusions at the height desired within vertical cavity 104. More specifically, a lower contact surface 176 (FIG. 3) provided by third portion 148 on each metal sheet 140 rests upon protrusions 96. Support assembly 106 moves by sliding lower contact surfaces 176 across protrusions 96. Once shelf 120 is full inserted into cavity 104, a lock 172 that is pivotally attached to opposing side wall 112 engages with a finger 170 to prevent shelf 120 from being removed from cavity 104 by sliding along lateral direction L. By pivoting each lock 172 towards rear wall 118, fingers 170 are disengaged on each side 136 so that shell support assembly 106 and shelf 120 can be removed for cleaning and/or height adjustment. As support assembly 106 is reinserted into cavity 104 on a pair of protrusions 96, a stop 168 positioned on second portion 146 of the metal sheet 140 of each shelf support 138 makes contact with a bend in protrusions 96 to limit the extent to which shelf support assembly 106 can be slid into cavity 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An extendable shelf support assembly for an appliance, the shelf support assembly defining vertical, lateral, and transverse directions, the shelf support assembly, comprising:
- a shelf extending between a pair of opposing sides;
- a pair of shelf supports spaced apart from each other in the lateral direction and positioned along the opposing sides of the shelf, the shelf configured to slide between the pair of shelf supports, each shelf support comprising
  - a metal sheet extending longitudinally along the transverse direction between a pair of distal ends, the metal sheet being folded to define
    - a first portion extending along the vertical direction;
    - a second portion and a third portion that are both parallel to the lateral direction and connected along one side to create a channel that extends longitudinally along the transverse direction; and
  - the metal sheet also defining a pair of fingers, one at each distal end,
- each finger extending parallel to the lateral direction from the second portion or the third portion into a portion of the channel at each finger's respective end toward each other and welded to the second portion, third portion, or both.

2. An extendable shelf support assembly as in claim 1, further comprising:
- a brace extending along the lateral direction between a pair of ends, each end of the brace being inserted into one of the channels formed by the pair of shelf supports.

3. An extendable shelf support assembly as in claim 2, wherein each end of the brace is welded to one of the shelf supports.

4. An extendable shelf support assembly as in claim 1, wherein the shelf comprises expanded metal.

5. An extendable shelf support assembly as in claim 1, further comprising a pair of slide assemblies, each slide assembly comprising
- a carrier attached to one of the opposing sides of the shelf; and
- a base onto which the carrier is slidably received such that carrier can be slid along the base, the base attached to the first portion of the metal sheet of one of the shelf supports.

6. An extendable shelf support assembly as in claim 1, wherein the pair of fingers comprise folds in the metal sheet.

7. An appliance comprising the extendable shelf support assembly of claim 1.

8. A shelf support assembly for an appliance, the shelf support assembly defining vertical, lateral, and transverse directions, the shelf support assembly, comprising:
- a shelf extending between a pair of opposing sides;

a pair of shelf supports spaced apart from each other in the lateral direction and upon which the shelf is suspended, each shelf support comprising a metal sheet extending longitudinally along the transverse direction between a pair of distal ends the metal sheet being folded to define a first portion lying in a plane orthogonal to the lateral direction;

a second portion lying in a plane orthogonal to the vertical direction;

a third portion lying in a plane orthogonal to the vertical direction, wherein the third portion and second portion are joined along one side of the shelf support to create a U-shaped slot; and a pair of fingers, each finger connected with one of the distal ends of shelf support, each finger extending from and parallel to the second portion or the third portion into a portion of the U-shaped slot at each finger's respective end toward each other.

9. A shelf support assembly for an appliance as in claim 8, further comprising:

a pair of slide assemblies, each slide assembly comprising a carrier attached to one of the opposing sides of the shelf; and a base onto which the carrier is slidably received such that carrier can be slid along the base while supporting the shelf.

10. A shelf support assembly for an appliance in in claim 8, wherein the shelf comprises expanded metal.

11. A shelf support assembly for an appliance as in claim 8, further comprising:

a brace extending along the lateral direction and connected to the U-shaped slot of each shelf support.

12. A shelf support assembly as in claim 11, wherein each end of the brace is welded to one of the shelf supports.

13. A shelf support assembly as in claim 11, wherein the U-shaped slot of each shelf support extends along the longitudinal direction of each shelf support.

14. An appliance comprising the shelf support assembly of claim 11.

15. An oven appliance, comprising a cabinet having an oven cavity defined by a pair of opposing side walls, a rear wall, a top wall, and a bottom wall, the cabinet also defining lateral, transverse, and vertical directions;

a pair of protrusions defined, each protrusion defined by one of the opposing walls of the cavity, each protrusion extending longitudinally along the transverse direction;

a shelf support assembly supported by the pair of protrusions, the shelf support assembly comprising:

a shelf extending between a pair of opposing sides;

a pair of shelf supports spaced apart from each other in the lateral direction and positioned along the opposing sides of the shelf, the shelf configured to slide between the pair of shelf supports, each shelf support comprising a metal sheet extending longitudinally along the transverse direction between a pair of distal ends, the metal sheet being folded to define a first portion extending along the vertical direction;

a second portion and a third portion that are both parallel to the lateral direction and connected along one side to create a channel that extends longitudinally along the transverse direction, the third portion of each shelf support resting on one of the pair of protrusions; and the metal sheet also defining a pair of fingers, one at each distal end, each finger extending parallel to the lateral direction from the second portion or the third portion into a portion of the channel at each finger's respective end toward each other and welded to the second portion, third portion, or both.

16. An oven appliance as in claim 15, wherein the shelf support assembly further comprises a brace extending along the lateral direction between a pair of ends, each end of the brace being inserted into one of the channels formed by the pair of shelf supports.

17. An oven appliance as in claim 16, wherein each end of the brace is welded to one of the shelf supports.

18. An oven appliance as in claim 15, wherein the shelf comprises expanded metal.

19. An oven appliance as in claim 15, wherein the channel in each shelf support is U-shaped.

* * * * *